US007540098B2

(12) United States Patent
Bast et al.

(10) Patent No.: US 7,540,098 B2
(45) Date of Patent: Jun. 2, 2009

(54) SANDAL WITH REMOVABLE UPPER

(76) Inventors: Linda Bast, 9000 Turnberry Dr., Burr Ridge, IL (US) 60527; Coleen Pfannenstiel, 9020 Turnberry Dr., Burr Ridge, IL (US) 60527

( * ) Notice: Subject to any disclaimer, the term of this patent is extended or adjusted under 35 U.S.C. 154(b) by 643 days.

(21) Appl. No.: 11/306,685

(22) Filed: Jan. 6, 2006

(65) Prior Publication Data

US 2008/0229616 A1 Sep. 25, 2008

(51) Int. Cl.
*A43B 3/12* (2006.01)

(52) U.S. Cl. ..... 36/11.5; 36/100; 36/101

(58) Field of Classification Search ..... 36/11.5, 36/15, 100, 101
See application file for complete search history.

(56) References Cited

U.S. PATENT DOCUMENTS

| | | | | |
|---|---|---|---|---|
| 2,438,711 | A | 3/1948 | Leach et al. | |
| 2,491,297 | A | 12/1949 | Brown | |
| 2,607,133 | A | 8/1952 | Marlowe | |
| 3,256,529 | A | 6/1966 | Panepinto | |
| 3,553,754 | A * | 1/1971 | Mendelsohn | 12/142 S |
| 3,983,642 | A | 10/1976 | Liao | |
| 4,172,330 | A | 10/1979 | Kao | |
| 4,461,102 | A | 7/1984 | DeVincentis | |
| 4,497,123 | A * | 2/1985 | Ehrlich | 36/32 R |
| 4,864,736 | A * | 9/1989 | Bierk | 36/11.5 |
| 5,185,942 | A | 2/1993 | Decker | |
| 6,311,413 | B1 | 11/2001 | Chern et al. | |
| 2002/0194750 | A1 | 12/2002 | Feick | |
| 2005/0016019 | A1 | 1/2005 | Smith et al. | |
| 2005/0120589 | A1 | 6/2005 | Coomes | |
| 2006/0201027 | A1 * | 9/2006 | Wu | 36/11.5 |
| 2008/0052958 | A1 * | 3/2008 | Pan | 36/11.5 |
| 2008/0086825 | A1 * | 4/2008 | Mullen | 12/142 Q |

* cited by examiner

*Primary Examiner*—Marie Patterson
(74) *Attorney, Agent, or Firm*—Husch Blackwell Sanders LLP Welsh & Katz

(57) ABSTRACT

Sandals, particularly sandals known as thongs or flip-flops that have removable and interchangeable uppers that allow the wearer to have a single pair of soles and multiple uppers so that they can have multiple colors and styles of sandals without having to buy and store multiple complete sandals. The sandal has a sole and an upper where the upper is comprised generally of straps forming a Y shape. The portion of the upper at the top of the Y can vary in size and design as long as the upper has at least three distinct strap ends which are used as attachment points to the sole. The front attachment point, which is at the bottom of the Y, attaches to the front of the sole using a first opening that runs from the top surface to the bottom surface in the front portion of the sole. The back attachment points are located on the top strap ends of the Y. These can be a single point on each side, or for aesthetic reasons, these points can branch out into two or more strap ends. Each side can have a different number of strap ends.

8 Claims, 4 Drawing Sheets

SANDAL WITH REMOVABLE UPPER

FIELD OF INVENTION

This invention is related to the field of footwear, more particularly the type of sandal known as thongs or flip-flops. This invention relates particularly to thong sandals that have removable and interchangeable uppers that allow the wearer to have a single pair of soles and multiple uppers so that they can have multiple colors and styles of sandals without having to buy and store multiple complete sandals. A replaceable upper also allows replacement of worn or damaged uppers without having to buy an entire new pair of sandals. Further, if a pairs of soles becomes damaged, they can be replaced and used with the already purchased uppers.

BACKGROUND OF INVENTION

Fashion often requires that one's shoes, or sandals, match their outfit, thus requiring multiple pairs of sandals. In addition one may wish to have both casual sandals as well as dressy sandals. These many pairs of sandals not only cost money, but take up space, both in a closet or in a suitcase while traveling. Thus, having the ability to buy a single pair of soles of each style or heel height desired, but then having multiple pairs of uppers that can be attached to those soles allow the wearer to have more sandals with less cost and requiring less space. It is easier to pack 6 colors of sandals is you only need one pair of soles and can tuck in 6 sets of straps of various colors and materials.

Further, often the straps of the sandal are the first to wear out or get soiled. In this case, the ruined uppers can be thrown away, while the sole is kept. And, at times the sole may be damaged, while the uppers remain usable. In this case just the soles can be replaced. These situations result in a cost savings over having to but an entirely new pair of sandals.

While prior patents in this area address the subject of interchangeable uppers, none utilize the mechanism employed by this invention, which is simple, yet highly effective.

Published U.S. Patent application No. U.S. 2005/001619 A1, filed by Smith et al. shows a sandal with interchangeable upper which attaches by means of side hooks and hook engagers within the sole. A cable type pulley system within the sole is used to disengage the hooks.

Published U.S. Patent application No. U.S. 2002/0194750 A1 filed by FEICK shows a sandal with an interchangeable upper which attaches to the sole by means of snaps. Alternatively, it shows attaching the upper by means of buttons and buttons hole or a fastener that uses a socket and eyelet. This sandal only shows attachment of the upper along the front sides of the sole for a slip on type sandal.

U.S. Pat. No. 4,461,102, issued to DeVincentis on Jul. 24, 1984 shows a sandal with interchangeable uppers. The front and heel straps are secured by spring connectors that attach to studs in the sides of the sole.

U.S. Pat. No. 4,172,330, issued to Kao on Oct. 30, 1979 shows a thong type sandal with a removable strap wherein all attachment points are attached through the sole by means of either screws or loops, and button or pinned members.

U.S. Pat. No. 3,983,642, issued to Wei-Chi Liao on Oct. 5, 1976 shows a sandal type shoe where the front straps attach by a variety of means including putting strings through holes in the sides of the sole and tying the upper on; using a variety of hooks and harness methods. The back strap is secured over the heel of the shoe or under the instep and secured in a gap between the heel and the sole.

U.S. Pat. No. 2,607,133, issued to Marlowe on Aug. 19, 1952 also shows a shoe with a detachable upper. This shoe has two separate upper sections one for the fore foot and the other to secure around the ankle. The uppers are attached by means of brackets and clamps as well as mechanisms.

None of this art discloses a sandal with an interchangeable upper utilizing a simple mechanism for effective attachment of the upper while providing simple and easy removal and replacement. The mechanism for attachment of the upper also allows for different styles of uppers to be attached to the same sole. None of the art discussed discloses this particular invention.

SUMMARY OF INVENTION

It is an objective of this invention to provide a sandal with a removable and interchangeable upper to allow the wearer to change the uppers as required to match a particular outfit of clothing or to change from a casual sandal to a dressy sandal.

It is a further objective of this invention to allow many types, styles and colors of sandals to be owned with a minimum of cost and with a minimum of storage space required in either a closet or suitcase. It is also an objective of this invention to have a simple, yet effective mechanism for removal and replacement of the uppers that does not require any tools and which securely holds the upper to the sole.

Another objective of this invention is to allow replacement of damaged or soiled uppers, or soles, without the need to replace the entire sandal.

These objectives and more are fulfilled by a sandal having a sole and an upper where the upper is comprised generally of straps generally forming a Y shape. The portions of the upper at the top of the Y can vary in size and design as long as the upper has at least three distinct strap ends which are used as attachment points to the sole.

A front attachment point, which is at the bottom of the Y, attaches within the front portion of the sole through a first opening that runs from the top surface to the bottom surface in the front portion of the sole, generally in the area between where the first, or big toe and second toe would be located when the sandal is worn. The end of the front attachment point is threaded and is received into a threaded cap. The threaded end is fed through the hole from the top surface of the sole out the bottom surface and the cap is attached.

The cap is sized larger than the first opening and thus holds the front attachment point in place. To allow the cap to sit flush with the bottom of the sole, the first opening can have two diameters, with the smaller diameter on the top surface of the sole and being smaller than the diameter of the cap and the larger diameter being at the bottom surface of the sole and being larger than the diameter of the cap, there by allowing the cap to sit within the sole providing flat bottom surface.

The back attachment points are located on the top strap ends of the Y. These can be a single point on each side, or for aesthetic reasons, these points can branch out into two or more strap ends on either or both sides. Each side can have a different number of strap ends.

There are envisioned at least four distinct ways to attach the back attachment points to the sole. Each requires a shank to be positioned transversely between the right and left edges of sole with the ends of the shank accessible on each edge. The exact positioning of the shank between front to back of the sole may vary.

The attachment methods include having a hole located in each of the strap ends of the back attachment points to be pushed over an enlarged shank end. The hole can be round or preferably for this embodiment an elongated slit.

In another embodiment, the strap ends can also have a round hole, either with or without a reinforcing grommet. The hole is placed over a toggle on the shank ends and the toggle in then pivoted to hold the straps in place. In the third method the straps can be attached by screws passed through the holes in the straps and secured into the shank, which are threaded to receive the screws. Spare screws can be stored in the heel of the sandal.

Finally, in the preferred embodiment, there is a hinged clasp on the strap ends and the shank ends are configured to allow the clasp to be secured to them.

Where there are more than one strap end on either side, the additional straps can be attached in the same manner to addition shanks, or can be attached to addition attachment nodes on the edges of the sole spaced next to the shank ends.

These and other features and advantages of the present invention will be apparent from the following detailed description, in conjunction with the appended claims.

DESCRIPTION OF THE DRAWINGS

The benefits and advantages of the present invention will become more readily apparent to those of ordinary skill in the art after reviewing the following detailed description and drawings wherein.

DETAILED DESCRIPTION OF THE INVENTION

Figure 1:
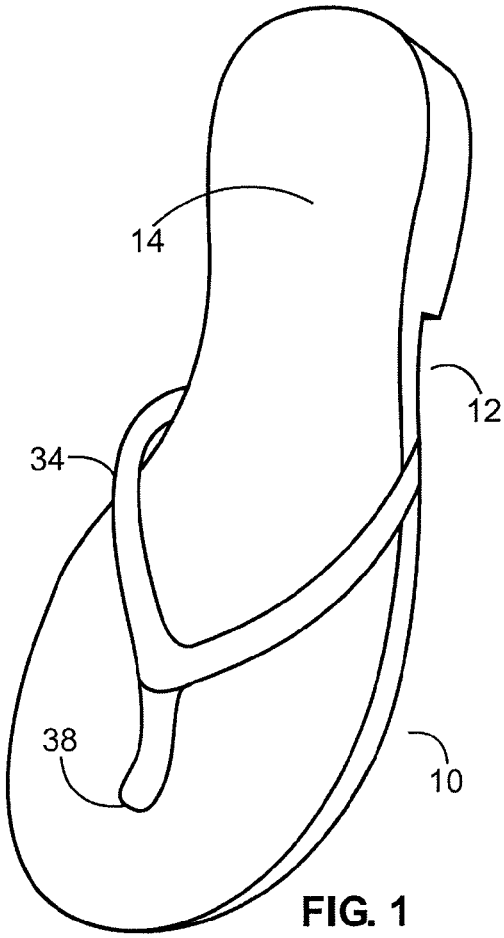
FIG. 1 is a top perspective view of the preferred embodiment of this invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated. If should be further understood that the title of this section of this specification, namely, "Detailed Description Of The Invention", relates to a requirement of the United States Patent Office, and does not imply, nor should be inferred to limit the subject matter disclosed herein.

The sandal 10, as shown in FIG. 1, includes a sole 12 and an upper 34. The sole 12 has a top surface 14 and a bottom surface 16. It also has a front portion 18 and a back portion 20 with a first opening 22 in the front portion 18 of the sole 12. The sole 12 also has a right edge 24 and a left edge 26. There is a shank 28 with shank ends 30 positioned transversely between the right edge 24 and left edge 26 of the sole and between the top surface 14 and bottom surface 16 with the shank ends 30 positioned at the edges 24 and 26 of the sole 12 for attachment of the upper 34.

The upper 34 is configured generally in a Y shape with at least three straps.

The first strap 36 is located at the bottom of the Y of the upper 34 and forms the front attachment point 38. The front attachment point 38 is threaded at the strap end 40. The threaded strap end 40 is passed through the first opening 22 at the top surface 14 of the sole 12 and through the bottom surface 16 and is affixed to a threaded cap 42. The cap 42 is sized so that it does not pass completely through the first opening 22.

Figure 6:
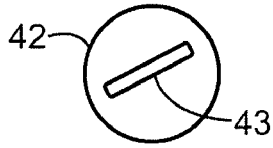
FIG. 6 is a bottom view of the cap, showing the slot for turning the cap while attaching or detaching the cap from the front attachment point.

Further, the first opening 22 is configured so that the cap 42 can sit flush with the bottom surface 16 of the sole 12 when fully secured to the threaded end 40. The cap 42 can have a slot 43 as shown in FIG. 6 to allow a coin to be used to attach and detach the cap 42 from the threaded end 40.

Figure 12A:
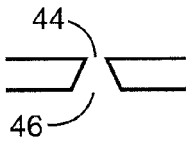
FIG. 12*a*-12*b* is a side cutout view of the sole showing the configuration of the first opening in the front portion of the sole, showing the first opening empty and after attachment of the front attachment point to the cap.
Figure 12B:
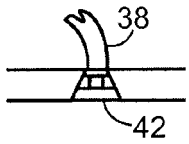
Figure 13A:
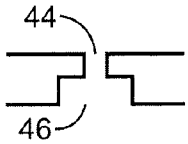
FIG. 13*a*-13*b* is a side cutout view of the sole showing another configuration of the first opening in the front portion of the sole, showing the first opening empty and after attachment of the front attachment point to the cap.
Figure 13B:
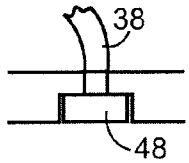

Two possible configurations for the first opening 22 are shown in FIGS. 12 and 13. In FIG. 12 the first opening 22 is a truncated cone shape with the smaller first opening in the top surface 14 of the sole 12. In FIG. 13 the first opening 22 has a smaller top section 44 and a larger bottom section 46 to receive the cap 22.

The second strap 48 is on the top right side of the Y, and the third strap 50 is on the top left side of the Y of the upper 34. The second strap 48 and the third strap 50 can be configured as in FIG. 3 so that a convention Y shape is formed by the first strap 36, second 48 and third 50 straps. In another embodiment, shown in FIG. 4, the second strap 48 and third strap 50 can be joined together for part of their length forming a solid middle potion 52 in the Y of the upper 34.

Figure 10:
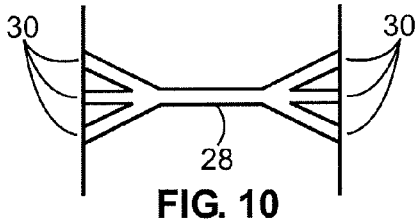
FIG. 10 is a detailed view of embodiment of the shank.
Figure 14:
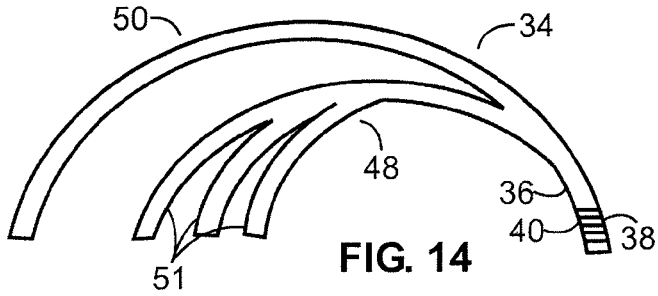
FIG. 14 is a side view of an embodiment of the upper.

In another embodiment of the upper the second strap 48 and/or the third strap 50 can be split into multiple sections 51, as shown for the second strap 48 in FIG. 14. In such a configuration the shank 28 could be modified to have multiple shank ends as shown in FIG. 10. Alternatively, a plurality of shanks 28 can be position within the sole 12 to secure the multiple sections of the back attachment points 56.

Figure 15:
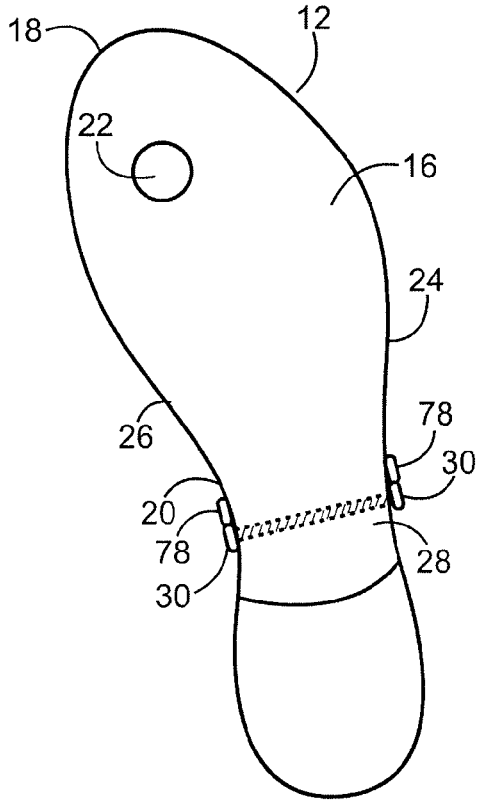
FIG. 15 and FIG. 16 are a button view an embodiment of the sole showing additional attachments nodes not associated with a shank.

Alternatively, instead of have multiple shank ends 30 to hold multiple sections 51 of either the second strap 48 or third strap 50, there can be additional attachment points 78 not associated with a shank, as shown in FIG. 15.

It is noted that the second strap 48 and third straps 50 do not need to be divided into the same number of sections. For example, the second strap 48 can be split into three sections, while the third strap 50 still has a single section.

The second strap 48 and the third strap 50 form the back attachment points 56. Generally, the back attachment points 56 will each attach to the shank 28 in the same manner. However, for aesthetic reasons different attachment methods as described herein can be used. In addition, separate sections of the second and third straps 48, 50 can be attached by different methods.

Figure 3:
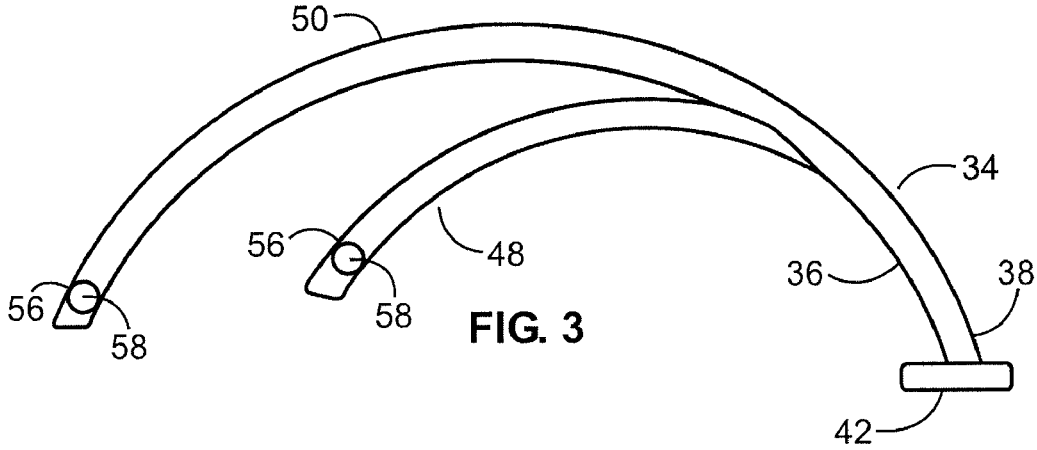
FIG. 3 is a side view of the upper of one embodiment of the invention.
Figure 4:
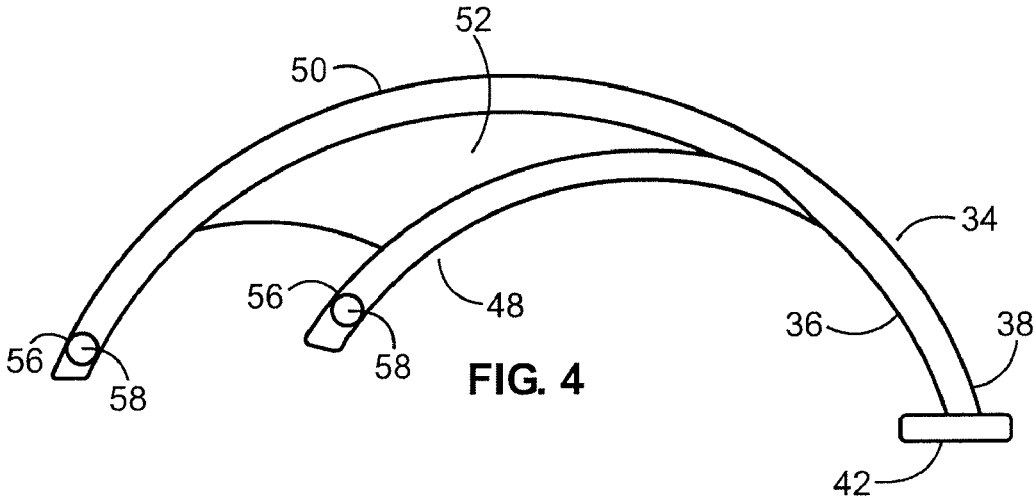
FIG. 4 is a side view of another embodiment of the upper.
Figure 5:
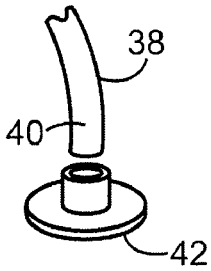
FIG. 5 is a detailed view of the front attachment point and the cap.
Figure 16:
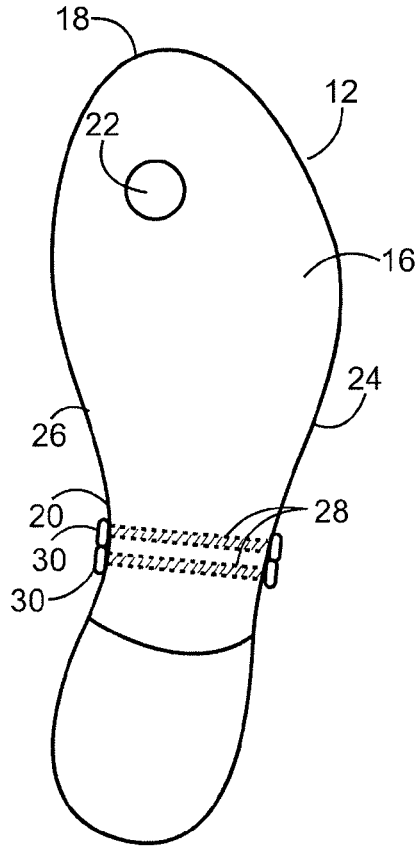

In one embodiment of the invention the back attachment points 56 are comprised of holes 58 in the second and third straps 48, 50 and the shank ends 30 are enlarged (FIG. 15) to received and hold the back attachment points 56. The holes 58 can be regular round holes 58 as shown in FIGS. 3 and 5, or can be slits 60 as shown in FIG. 16.

Figure 11A:
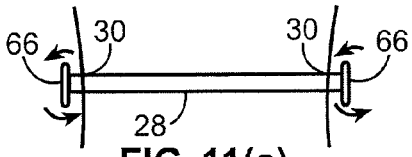
FIG. 11*a*-11*b* is a detailed view of the shank with a toggle on each shank end, showing the toggle open and closed.
Figure 11B:
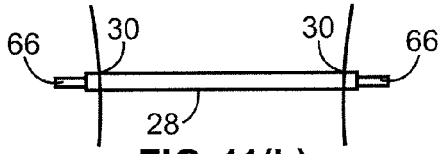

Another embodiment of the invention utilizes toggles 66 to pass through and secure the holes 58 in the second and third straps 48, 50. The holes 58 can be simply holes in the material of the straps or can be reinforced with grommets. The toggles 66, as shown in FIG. 11 pivot to allow the holes to pass over them and then pivot back to secure the back attachment points 56 in place.

Figure 8:
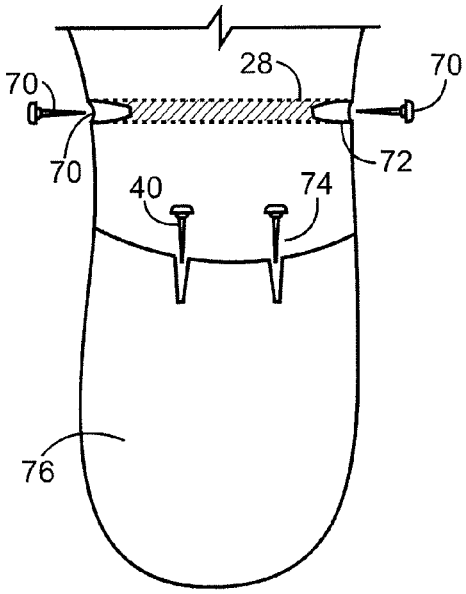
FIG. 8 is the back portion of the sole showing another embodiment of the shank.
Figure 9:
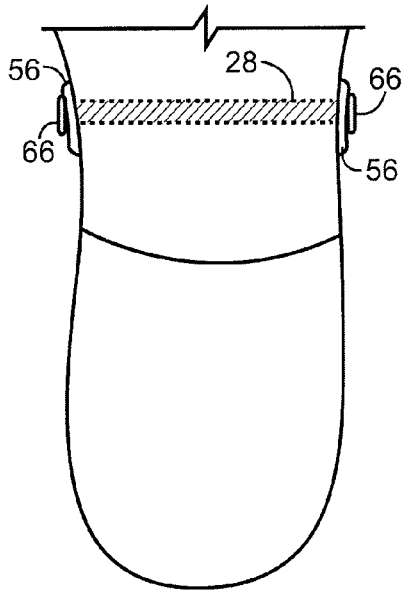
FIG. 9 is the back portion of the sole showing yet another embodiment of the shank.

Yet another embodiment uses screws 70 to secure the back attachment points 56 to the shank 28. In this embodiment the shank ends 30 have a recess 72 therein, said recess 72 being internally threaded to receive a screw 70, as shown in FIG. 8. Spare screws 74 can be stored in the heel 76.

In the preferred embodiment of this invention, the front attachment point 38 is secured to the cap 42 which sits flush with the bottom surface 16 of the sole 12 as shown in FIG. 13. The cap 42 is easily attached and detached form the threaded end 40 by the use a coin placed in the slot 43.

Figure 2:
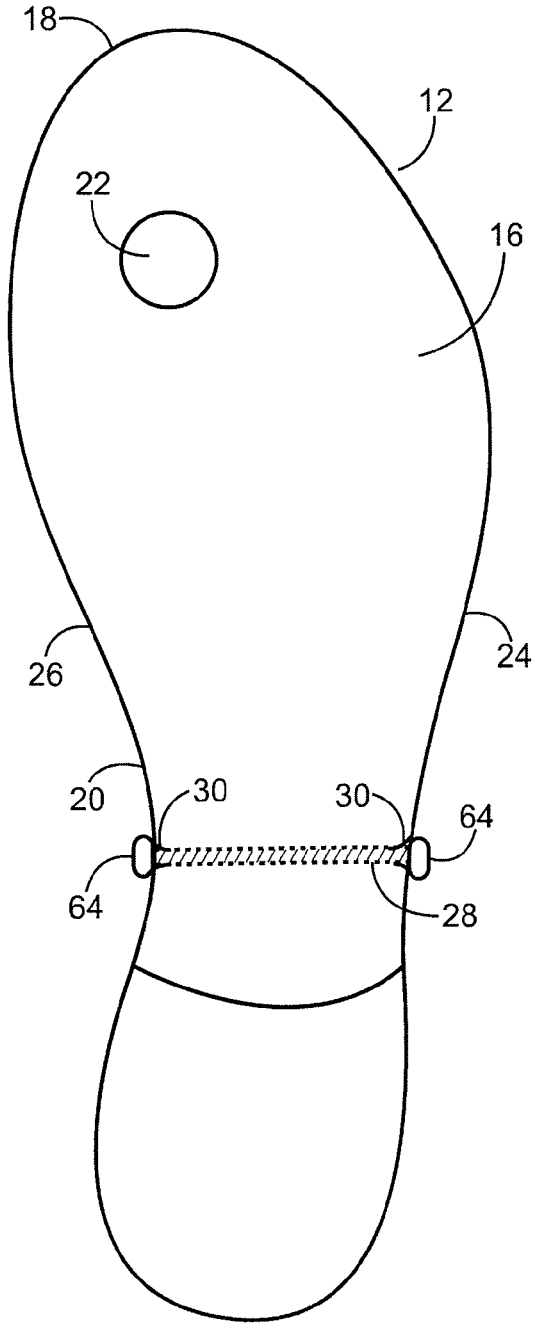
FIG. 2 is a bottom view of the sole showing the shank of the preferred embodiment of this invention.
Figure 7A:
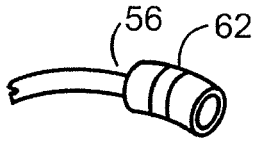
FIG. 7*a*-7*c* is a detailed view of the hinged clasp of the preferred embodiment, showing the clasp in closed, open and attached positions.
Figure 7B:
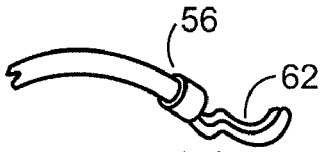
Figure 7C:
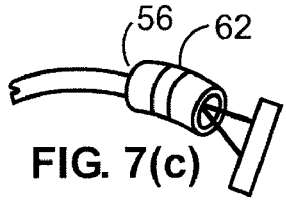

In a preferred embodiment of the invention the back attachment points 56 are comprised of a hinged clasp 62 that is located on the second and third straps 48, 50, as shown in FIG. 7. The shank ends 30 are configured to have a space 64 to received and secure the hinged clasp, as shown in FIG. 7*c*. The space 64 at the shank ends 30 can be triangle or stirrup shaped, as shown in FIG. 2 or any other shape that is able to receive and hold the clasp 62.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A sandal with a removable upper comprising:

a sole having a top surface and bottom surface; a right and a left edge; a front and rear portion; further having an first opening in the front portion of the sole from the top surface through the bottom surface and having at least one shank with a plurality of shank ends positioned transversely between the right and left edges of the sole and between the top and bottom surfaces with the ends of the shank positioned at the right and left edges of the sole for attachment of the upper;

an upper having a plurality of back attachment points and at least one front attachment point for removably attaching the upper to the sole utilizing the first opening and the shank ends; with the front attachment point consisting of a threaded strap end which is inserted through the first opening from the top surface of the sole and secured by a threaded cap under the bottom surface of the sole, said cap sized to not pass through the first opening when fully secured to the threaded end; and the back attachment points removably securable to the shank ends.

2. The sandal of claim 1 wherein the upper is comprised of a plurality of straps configured in the shape of a Y; with a front attachment point located on a bottom of the Y; and a plurality of back attachment points located at the ends of a right and a left strap located at the top of the Y, with at least one back attachment point on the right strap and one back attachment point on the left strap removably securable to the shank ends.

3. The sandal of claim 1 wherein the first opening within the sole has an upper and a lower section wherein the diameter of the upper section is smaller than the diameter of the lower section and the lower section is larger than the threaded cap, thereby allowing the threaded cap to sit inside the lower section of said first opening when secured to the threaded strap end.

4. The sandal of claim 1 wherein the back attachment points are further comprised of holes at the strap ends of the right and left straps and the shank ends being enlarge to receive and secure said holes.

5. The sandal of claim 1 wherein the back attachment points are further comprised of holes in the right and left straps and the shank ends have a pivoting toggle to receive and secure the back attachment points.

6. The sandal of claim 1 wherein the back attachment points each have a hinged clasp at the end of the right and left strap ends and the shank ends are configured to receive and secure the clasp.

7. The sandal of claim 1 wherein the shank ends have a recess therein, said recess being internally threaded to receive a screw;

the screw passing through the holes in the back attachment points and engaging the threads within the ends of the shank.

8. The sandal of claim 1 wherein not all of the back attachment points are secured to a corresponding shank end, but are secured to secondary attachments nodes located on the right and left edges of the sole.

* * * * *